US005428962A

United States Patent [19]

Rieth

[11] Patent Number: 5,428,962

[45] Date of Patent: Jul. 4, 1995

[54] PROCESS AND INSTALLATION FOR THE PRODUCTION OF AT LEAST ONE GASEOUS PRODUCT UNDER PRESSURE AND AT LEAST ONE LIQUID BY DISTILLATION OF AIR

[75] Inventor: Norbert Rieth, Paris, France

[73] Assignee: L'Air Liquide, Societe Anonyme pour l'Etude et l'Exploitation des Procedes Georges Claude, Paris, France

[21] Appl. No.: 169,984

[22] Filed: Dec. 16, 1993

[30] Foreign Application Priority Data

Jan. 5, 1993 [FR] France ..... 93 00035

[51] Int. Cl.[6] ..... F25J 3/02

[52] U.S. Cl. ..... 62/25; 62/38; 62/41

[58] Field of Search ..... 62/24, 25, 38, 41

[56] References Cited

U.S. PATENT DOCUMENTS 5,037,462 8/1991 Schweigert ..... 62/24

FOREIGN PATENT DOCUMENTS 0286314 10/1988 European Pat. Off. .
0413631 2/1991 European Pat. Off. .
2252616 8/1992 United Kingdom .

*Primary Examiner*—Ronald C. Capossela
*Attorney, Agent, or Firm*—Young & Thompson

[57] ABSTRACT

Process and installation for the production of gaseous oxygen and/or gaseous nitrogen under pressure and of at least one liquid product by an installation comprising a single air distillation column (9) provided with a nitrogen refrigeration cycle. The air to be treated is compressed (in 1) to a first pressure at least equal to the pressure of the single column. At least a portion of the air is further compressed (in 4; 4, 4A) to a high pressure substantially greater than the pressure of the single column. A fraction of this air is condensed (in 7) by vaporization of liquid oxygen and/or liquid nitrogen withdrawn from the base of the column and pumped (in 14, 15) to the corresponding vaporization pressure. The gaseous oxygen and/or gaseous nitrogen is recovered (in 30, 28) under the resulting pressure, as product. The air thus condensed is subcooled (in 11), expanded to about the pressure of the column (in 20, 21), and introduced at least in part into an intermediate level of the column. The air not used to vaporize the liquid oxygen and/or liquid nitrogen is expanded to the pressure of the column, with the production of external work (5, 5A); and there is withdrawn from the installation at least one liquid which is recovered as product.

13 Claims, 2 Drawing Sheets

Figure 1:
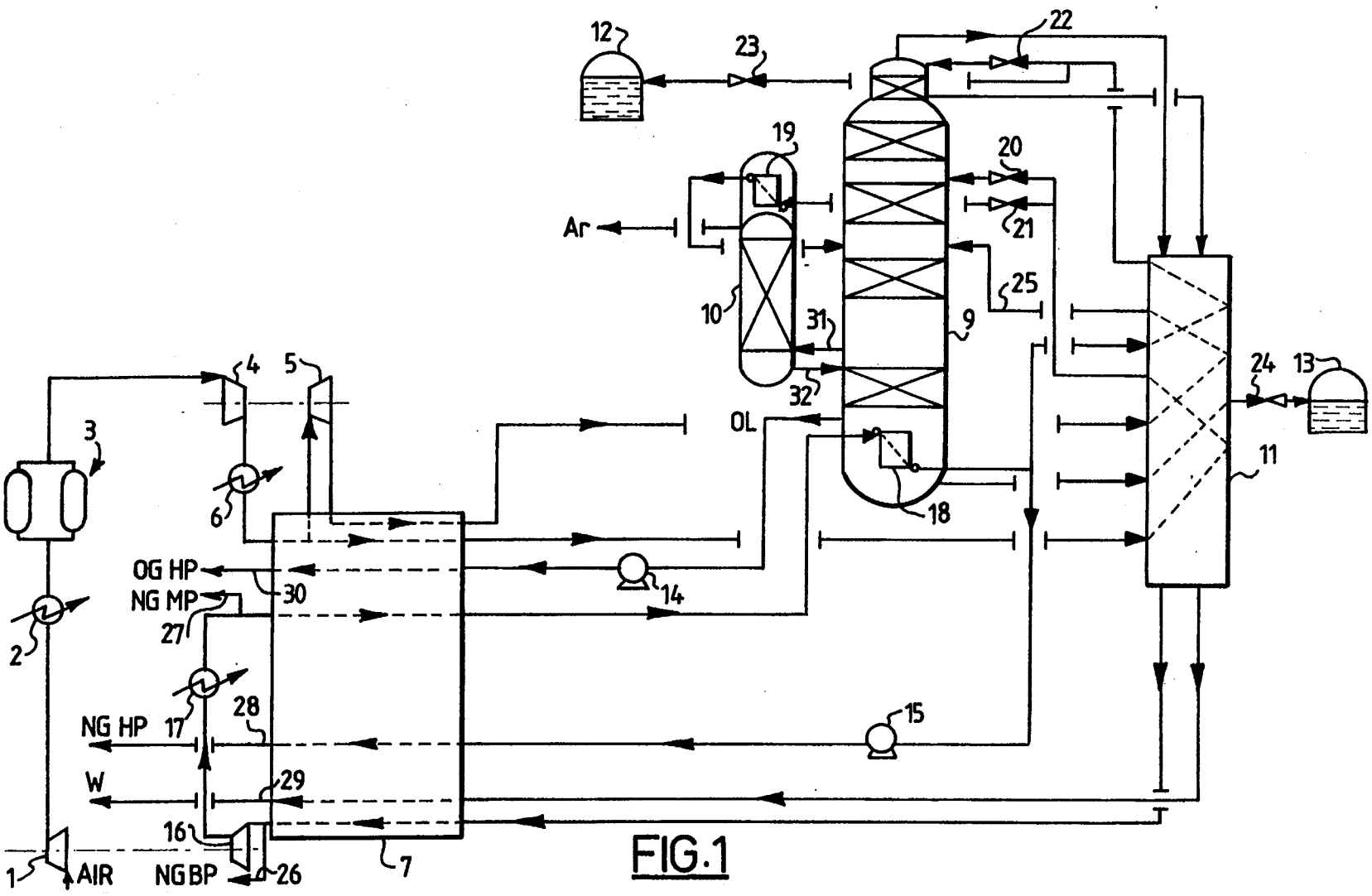

PROCESS AND INSTALLATION FOR THE PRODUCTION OF AT LEAST ONE GASEOUS PRODUCT UNDER PRESSURE AND AT LEAST ONE LIQUID BY DISTILLATION OF AIR

The present invention relates to a process for the production of gaseous oxygen and/or nitrogen under pressure and of at least one liquid product by means of an installation comprising a single air distillation column provided with a nitrogen refrigeration cycle.

The pressures in question in the present text are absolute pressures.

The invention has for its object to make use of the advantageous properties of single distillation columns with nitrogen refrigeration cycle (reduced investment, moderate consumption of energy, uncoupling product purity from extraction efficiency) to produce in a particularly flexible and economical manner oxygen and/or nitrogen under pressure, in gaseous phase, as well as at least one liquid product.

To this end, the process according to the invention is characterized in that:

the air to be treated is compressed to a first pressure at least equal to the pressure of the single column;

at least a portion of the air is highly compressed to a high pressure substantially greater than the pressure of the single column;

a fraction of this air is condensed by vaporization of liquid oxygen and/or liquid nitrogen withdrawn from the base of the column and pumped to the corresponding vaporization pressure, and the gaseous oxygen and/or gaseous nitrogen under the resulting pressure are recovered as product;

the air thus condensed is subcooled, expanded to about the pressure of the column, and introduced at least in part into an intermediate level of the column;

the air not used to vaporize the liquid oxygen and/or nitrogen is expanded to the pressure of the column, with the production of external work; and there is withdrawn from the installation at least one liquid product, which is recovered as such.

According to other characteristics:

there is withdrawn from the base of the single column liquid nitrogen at the high pressure of the cycle, leaving the vaporizer at the base of the column;

a portion of the air condensed and expanded is used to cool the head condenser of an impure argon production column coupled to the single column, and there is sent into this latter the gaseous air leaving this condenser;

said expansion with production of external work comprises the expansion in a first turbine of the air that has not been highly compressed, and the expansion in a second turbine of a fraction of the air that has been highly compressed;

the second turbine has an inlet temperature less than that of the first turbine;

a portion of the nitrogen at the high pressure of the cycle is also expanded to about the pressure of the single column, with the production of external work;

the pressure of the single column is substantially greater than atmospheric pressure.

The invention also has for its object an installation adapted to practice such a process. This installation is characterized in that it comprises:

a principal compressor compressing the air to be treated to a first pressure at least equal to the pressure of the single column;

means to highly compress at least a portion of the air to a high pressure substantially greater than the pressure of the single column;

at least one pump withdrawing liquid oxygen and/or liquid nitrogen from the base of the column and forcing it into a heat exchanger adapted to vaporize these liquids while condensing the highly compressed air;

means (30, 28) to recover the gaseous oxygen and/or nitrogen under the resulting pressure, as products;

means to subcool the highly compressed condensed air and to introduce at least a portion thereof into an intermediate level of the column; and at least one turbine to expand to about the pressure of the column, the air not utilized to vaporize the liquid oxygen and/or the liquid nitrogen; and means to withdraw at least one liquid product from the installation and to recover it as product.

The principal compressor and the compressor of the nitrogen cycle of this installation can particularly be constituted by a single machine.

Figure 2:
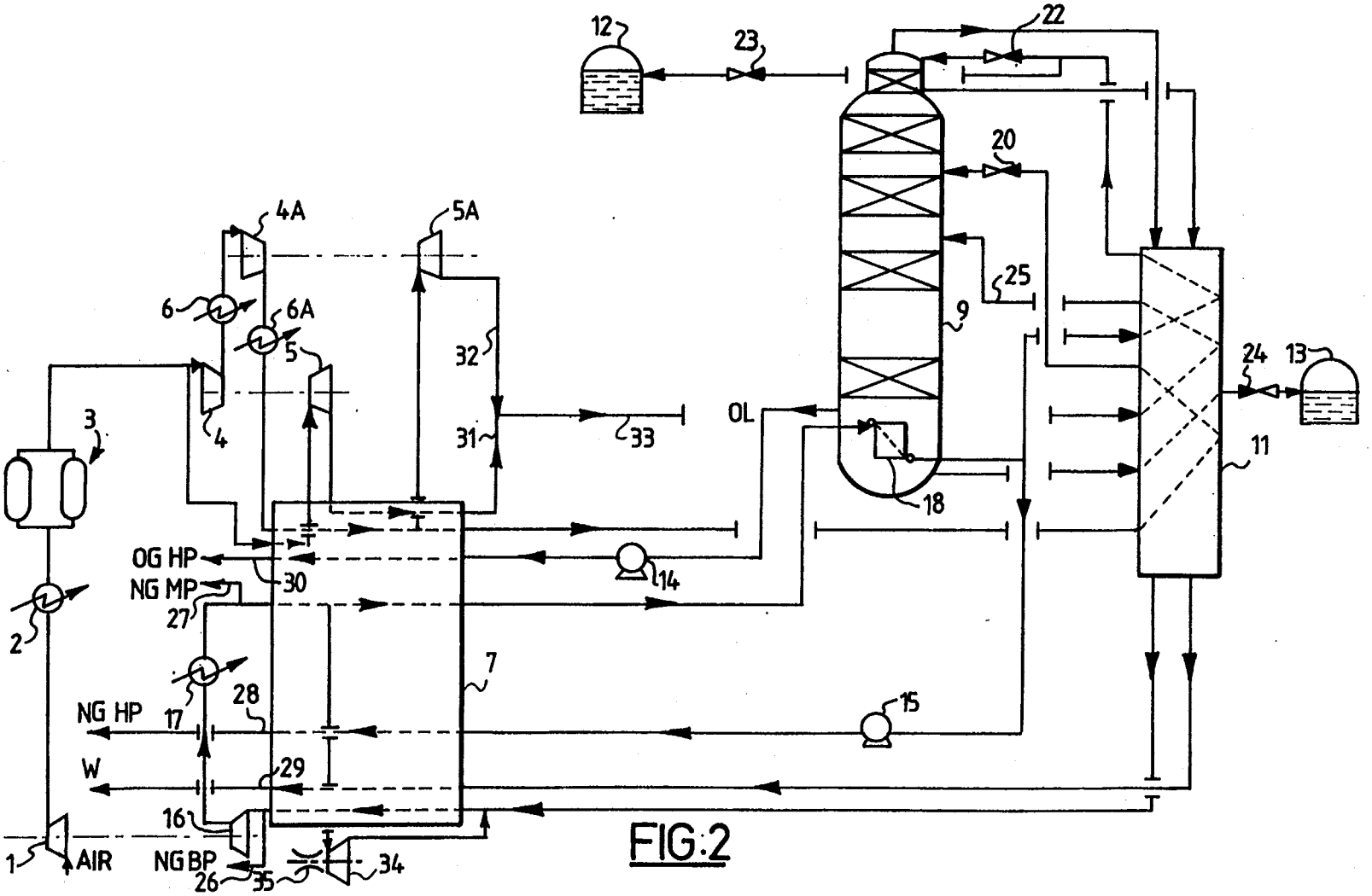

Examples of embodiment of the invention will now be described with respect to the accompanying drawings, in which FIGS. 1 and 2 show schematically, respectively, a first and a second embodiment of the installation according to the invention.

The installation shown in FIG. 1 is adapted to produce gaseous oxygen under pressure, gaseous nitrogen under pressure, liquid oxygen, liquid nitrogen and argon. It comprises essentially: a principal air compressor 1 provided with a refrigerant 2 of atmospheric air or water; apparatus 3 for purification by adsorption; a blower 4-turbine 5 assembly having its two wheels mounted on the same shaft, the blown gas also being provided with a refrigerant 6 of air or water; a heat exchange line 7; a single air distillation column 9; a column 10 for the production of impure argon coupled to the preceding one; a subcooler 11; sources 12 of liquid nitrogen and 13 of liquid oxygen under atmospheric pressure; liquid oxygen pump 14 and liquid nitrogen pump 15; and a compressor 16 for the nitrogen refrigeration cycle provided with a refrigerant 17 which is air or water. The single column 9 comprises a bottom vaporizer 18, while the column 10 comprises a head condenser 19. The installation also comprises expansion valves 20 to 24.

To reduce the capital cost, the compressors 1 for air and 16 for the nitrogen cycle are combined in a single rotary machine.

In operation, the entering air is compressed between 5 and 10 bars in 1, cooled to about the ambient temperature in 2, purified of water and carbon dioxide in 3, and all of it is compressed in 4 to a high pressure of the order of 6.5 to 13 bars.

After precooling to about ambient temperature in 6, the highly compressed air enters the warm end of the heat exchange line 7 and is cooled to an intermediate temperature, at which 60 to 80% of its flow rate is removed from the heat exchange line, expanded in 5 to substantially the pressure of the column 9, the so-called low pressure, comprised between 1.3 and 2 bars, then reintroduced into the heat exchange line, cooled until it reaches the cold end of the latter, cooled again in 11, and introduced at an intermediate level into the conduit 9 via a conduit 25.

The fraction of the highly compressed air that is not expanded continues its cooling and is liquefied in the cold portion of the heat exchange line. It is then subcooled in 11. A portion of this air is expanded to the pressure of the column 9, in 20, and introduced into an intermediate level of the latter, while the rest of this air is expanded in 21 and supplied to the head condenser 19 of the column 10, in which it is vaporized, then is returned into the column 9 in gaseous phase.

The nitrogen cooling cycle of the installation is supplied by practically pure nitrogen product in the head of the column 9, partially reheated in 11 and reheated to ambient temperature in 7. A fraction of this low pressure nitrogen can be recovered as product via a conduit 26, and the rest is compressed to a medium pressure, which is the high pressure of the cycle, by the compressor 16, then brought to about ambient temperature in 17. A portion of the medium pressure nitrogen can be recovered as product via a conduit 27, and the rest is cooled until it reaches the cold end of the heat exchange line, to about its dew point, then is condensed in the vaporizer 18 of the column 9.

A portion of the condensed nitrogen is pumped in 15 to a high production pressure of the order of 7 to 40 bars, and the liquid nitrogen under this high pressure is vaporized in the heat exchange line by condensation of the highly compressed air, reheated to ambient temperature, then recovered as product via a conduit 28. The rest of the condensed nitrogen is 5 subcooled in 11, then, in part, expanded in 22 and introduced as reflux at the head of the column 9, and, as to the rest, expanded to atmospheric pressure in 23 and introduced into the liquid nitrogen source 12. As a modification, to limit the flash within the source 12, this latter can be supplied from liquid nitrogen withdrawn from the head of the column.

The flow of impure gaseous nitrogen, constituting the residual gas of the installation, is withdrawn from the column at a level comprised between those for the injection of liquid nitrogen and liquid air, reheated in 11 and then in 7 to ambient temperature, and evacuated via a conduit 29.

Liquid oxygen is moreover withdrawn from the base of the column 9, pumped at 14 to the desired high production pressure, of the order of 2 to 40 bars, vaporized in the cold portion of the heat exchange line by condensation of high pressure air, reheated to ambient temperature, and recovered as product through a conduit 30.

Liquid oxygen is moreover withdrawn from the base of column 9 and, after subcooling in 11 and expansion to atmospheric pressure in 24, sent to the liquid oxygen supply 13.

The base of the column 10 is connected to an intermediate level of the column 9 by supply conduit 31 and return conduit 32, and this column 10 produces impure argon via a conduit 33.

The installation of FIG. 2 differs from that of FIG. 1 only as to the following points.

On the one hand, the installation does not comprise an auxiliary column 10, whereby all of the liquid liquefied in the heat exchange line is, after subcooling in 11 and then expansion in 20, injected into the single column 9.

On the other hand, the entering air circuit comprises two blowers 4 and 4A in series, with their respective air or water coolers 6 and 6A, and two air expansion turbines 5 and 5A, coupled respectively to the two blowers.

In this modification, 30 to 40% of the entering air flow is introduced into the warm end of heat exchange line 7 without high compression, cooled to a first intermediate temperature T1, withdrawn from the heat exchange line, expanded in turbine 5 substantially to the pressure of column 9, reintroduced into the heat exchange line, and cooled in the cold end thereof, from which it leaves via a conduit 31.

The remaining 60 to 70% of the entering air is compressed in 4 and then 4A to a temperature of the order of 6.5 to 13 bars, then introduced into the warm end of the heat exchange line. It is cooled to a second intermediate temperature T2 less than T1, at which temperature 60 to 70% of this flow leaves the heat exchange line and is expanded in turbine 5A, from which it leaves substantially at the pressure of the column 9 via a conduit 32.

The conduits 31, 32 join in a conduit 33. The air carried by this latter is again cooled in 11 and then introduced into the column, as before, via the conduit 25.

The high pressure air which is not expanded in 5A continues its cooling in the cold portion of the heat exchange line, in which it is liquefied by vaporization of high pressure liquid oxygen and liquid nitrogen as before.

Finally, a flow of high pressure gaseous nitrogen from the nitrogen cycle leaves the heat exchange line at an intermediate temperature, is expanded to the low pressure of the cycle, which is substantially the pressure of the column 9, in a turbine 34 provided with a brake 35, and reinjected into the low pressure nitrogen conduit of the cycle at the cold end of the heat exchange line.

The presence of the two air turbines 5 and 5A improves the performance of the installation, while the nitrogen turbine 34 permits increasing its liquid production (liquid oxygen and/or liquid nitrogen).

What is claimed is:

1. In a process for the production of at least one of gaseous oxygen and gaseous nitrogen under pressure and of at least one liquid product by means of a single air distillation column (9) provided with a nitrogen refrigeration cycle; the improvement comprising:

compressing the air to be treated (in 1) to a first pressure at least equal to the pressure of the single column;

further compressing at least a portion of the air (in 4; 4, 4A) to a high pressure greater than the pressure of the single column;

condensing a fraction of the further compressed air (in 7) by vaporization of liquid withdrawn from the base of the column and pumped (in 14, 15) to the corresponding vaporization pressure, and recovering gas resulting from said vaporization (in 30, 28) under the resulting pressure, as product;

subcooling the air thus condensed (in 11), expanding the same to about the pressure of the column (in 20, 21), and introducing the same at least in part into an intermediate level of the column;

expanding the air not used to vaporize the liquid to the pressure of the column, with the production of external work (5, 5A); and withdrawing at least one liquid which is recovered as product.

2. Process according to claim 1, wherein the liquid nitrogen at the high pressure of the cycle is withdrawn from the base of the single column (9), via a base vaporizer (18) of the column.

3. Process according to claim 1, wherein a portion of a air that is condensed and expanded (in 21) is used to cool head condenser (19) of an impure argon production column (10) connected to the single column (9), and gaseous air from this condenser is sent into said single column (9).

4. Process according to claim 1, wherein said expansion with production of external work comprises the expansion in a first turbine (5) of the air that is not further compressed, and the expansion in a second turbine (5A) of a fraction of the highly compressed air.

5. Process according to claim 4, wherein the second turbine (5A) has an inlet temperature less than that of the first turbine (5).

6. Process according to claim 1, further comprising expanding to about the pressure of the single column (9), with production of external work (in 34), a portion of the nitrogen at the high pressure of the cycle.

7. Process according to claim 1, wherein the pressure of the single column (9) is greater than atmospheric pressure.

8. In an installation for the production of at least one of gaseous oxygen and gaseous nitrogen under pressure and of at least one liquid product by means of a single air distillation column (9) provided with a nitrogen refrigeration cycle; the improvement comprising:

a principal compressor (1) compressing the air to be treated to a first pressure at least equal to the pressure of the single column;

means (4; 4, 4A) to further compress at least a portion of the air to a high pressure greater than the pressure of the single column;

at least one pump (14,15) withdrawing at least one of liquid oxygen and liquid nitrogen from the base of the column and sending it into a heat exchanger (7) adapted to vaporize these liquids while condensing highly compressed air;

means (30, 28) to recover the resulting gaseous oxygen and/or gaseous nitrogen under the resulting pressure, as products;

means (11) to subcool the condensed highly compressed air and to introduce at least a portion thereof into an intermediate level of the column;

at least one turbine (5; 5, 5A) to expand to about the pressure of the column the air not utilized to vaporize the liquid oxygen and/or the liquid nitrogen; and means (12, 13)to withdraw at least one liquid product and to recover the same as product.

9. Installation according to claim 8, which also comprises an impure argon production column (10) connected to the single column (9) and provided with a head condenser (19), means to supply said head condenser with a portion of the subcooled highly compressed air, and means to return to the single column the gaseous air from said head condenser.

10. Installation according to claim 8, which further comprises a first turbine (5) for expanding at least a fraction of air that is not highly compressed, and a second turbine (5A) for expanding a fraction of the highly compressed air.

11. Installation according to claim 10, wherein the second turbine (5A) has an inlet temperature less than that of the first turbine (5).

12. Installation according to claim 8, which further comprises a third turbine (34) for expansion to about the pressure of the single column (9) of a portion of the nitrogen at the high pressure of the cycle.

13. Installation according to claim 8, wherein the principal compressor (1) and a compressor (16) of the nitrogen refrigeration cycle are constituted by a single machine.

* * * * *